US008915207B2

(12) United States Patent
Wirsig

(10) Patent No.: US 8,915,207 B2
(45) Date of Patent: Dec. 23, 2014

(54) WATERCRAFT STABILIZING DEVICE

(71) Applicant: Ralph C. Wirsig, Ottawa (CA)

(72) Inventor: Ralph C. Wirsig, Ottawa (CA)

( * ) Notice: Subject to any disclaimer, the term of this patent is extended or adjusted under 35 U.S.C. 154(b) by 179 days.

(21) Appl. No.: 13/737,886

(22) Filed: Jan. 9, 2013

(65) Prior Publication Data

US 2013/0206052 A1 Aug. 15, 2013

(51) Int. Cl.

| | |
|---|---|
| ***B63B 17/00*** | (2006.01) |
| ***B63B 39/00*** | (2006.01) |
| ***B63B 35/71*** | (2006.01) |
| *B63H 16/04* | (2006.01) |

(52) U.S. Cl.

CPC ..... *B63B 39/00* (2013.01); *B63B 35/71* (2013.01); *B63H 16/04* (2013.01); *B63B 2035/715* (2013.01)

USPC ..... 114/364

(58) Field of Classification Search

USPC ..... 114/343, 347, 362, 364

See application file for complete search history.

(56) References Cited

U.S. PATENT DOCUMENTS

| | | | | | |
|---|---|---|---|---|---|
| 2,526,871 | A * | 10/1950 | Johnson | 114/230.1 |
| 4,516,941 | A * | 5/1985 | Reid | 440/105 |
| 4,595,373 | A * | 6/1986 | Giroux | 440/104 |
| 4,862,818 | A | 9/1989 | Sullivan | |
| 5,501,169 | A * | 3/1996 | Denker | 114/364 |
| 5,657,713 | A * | 8/1997 | Rowlett | 114/61.1 |
| 5,773,802 | A * | 6/1998 | Graves | 219/759 |
| 6,050,210 | A * | 4/2000 | Grzybowski | 114/123 |
| 6,305,306 | B1 * | 10/2001 | Grzybowski | 114/123 |
| 6,659,032 | B1 * | 12/2003 | Simon | 114/123 |
| 6,928,949 | B1 * | 8/2005 | Simon | 114/347 |
| 7,182,032 | B1 | 2/2007 | Lindemann | |
| D652,781 | S * | 1/2012 | Steckline | D12/317 |
| 2011/0297067 | A1 | 12/2011 | Wirsig | |

* cited by examiner

*Primary Examiner* — Daniel V Venne
(74) *Attorney, Agent, or Firm* — Ronald G. Bitner

(57) ABSTRACT

An apparatus for stabilizing a watercraft, such as a kayak or canoe, for boarding or exiting, utilizing a paddle, comprising a quick insert/release paddle clamping device for mounting on a watercraft. The clamping device has laterally elongated jaws forming a C-shaped channel with a longitudinal slot for receiving a paddle shaft. The jaws have a deflectable lip portion configured to allow insertion and releasably retain the paddle shaft within the channel. The clamping device is mounted with the channel oriented horizontally and transverse to the fore-and-aft axis of the watercraft, with the slot disposed along a longitudinal side of the channel to allow insertion and removal the paddle shaft by fore-and-aft motion. Lateral spacing of paddle gripping regions minimizes twisting forces imposed on the clamping device when the outer end of the paddle engages an object to limit roll of the watercraft.

5 Claims, 1 Drawing Sheet

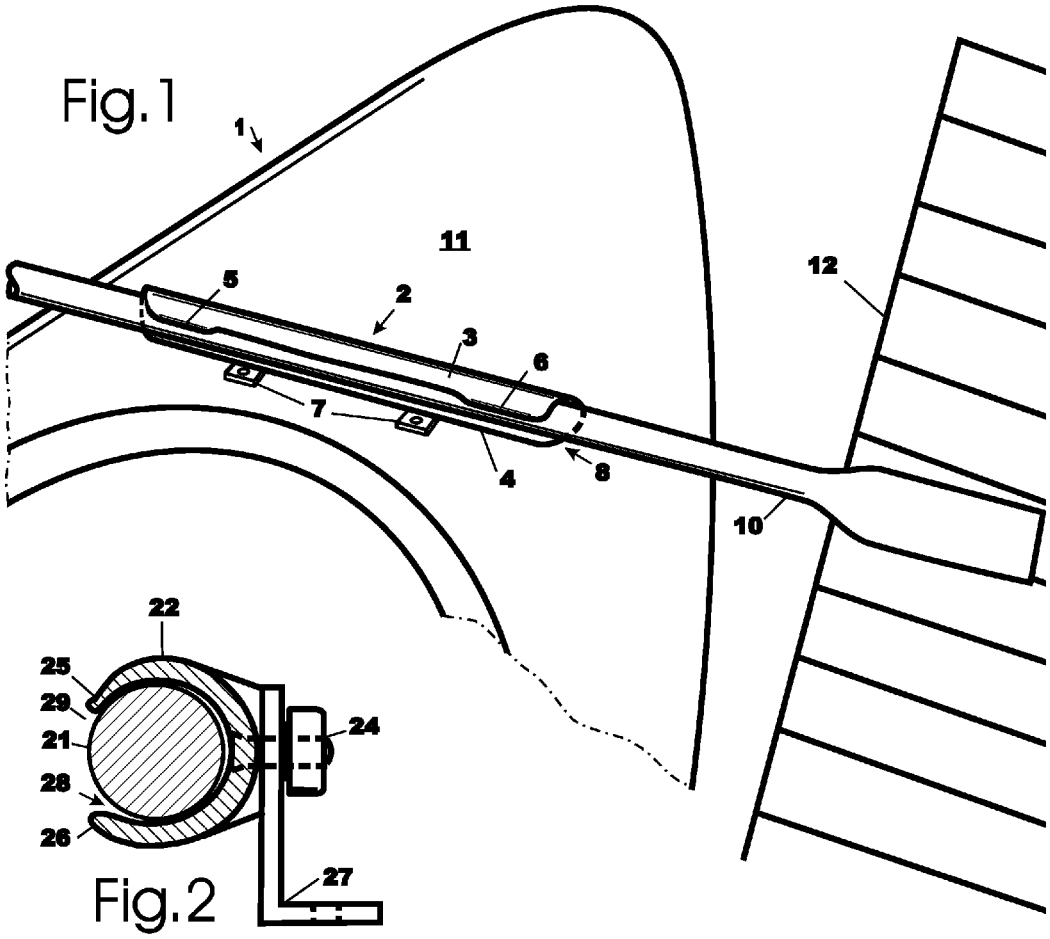
Fig.1
1
11
12
5
2
3
6
7
4
8
10
22
25
29
21
28
26
24
27
Fig.2
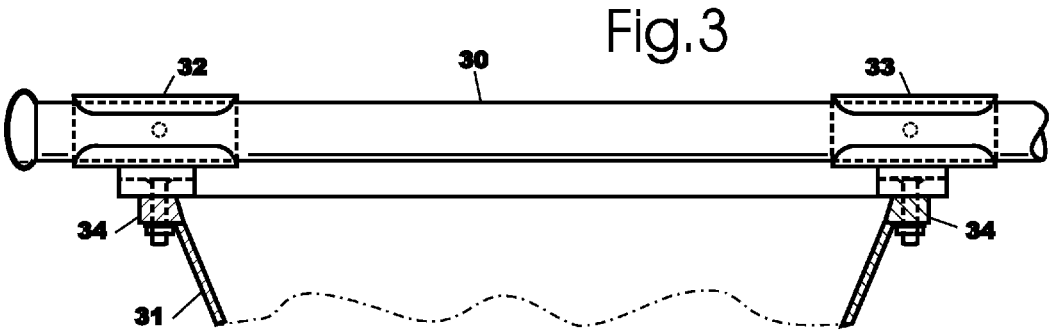
Fig.3
32
30
33
34
34
31

WATERCRAFT STABILIZING DEVICE

BACKGROUND OF THE INVENTION

1. Field of the Invention

This invention relates to an apparatus that facilitates boarding or exiting from a small watercraft, such as a kayak or canoe.

2. Description of the Prior Art

A difficulty with the use of small watercraft, such as kayaks or canoes, is that they tend to be unstable when the user is boarding or exiting. This is also the case when boarding from a dock or shore edge for launching. A technique commonly used by kayakers is the "paddle-bridge" approach which involves the use of a paddle to form a bridge between a dock or shore edge and kayak that helps stabilize the kayak for boarding. To use the "paddle-bridge" approach and various other similar techniques a kayaker needs to employ considerable skill and athleticism for kayak entry or exit where exiting a kayak is more difficult than entry, and both are more difficult yet when the elevation difference from the top of the dock or shore to the top of the kayak is more than a few inches. These levels of difficulty are often beyond the capabilities of people with reduced upper body strength and flexibility and novice kayakers.

An alternative to an unsuitable dock or shore line is entry/exit from a beach where the kayak is positioned part way up the beach thereby providing enough stability to enable the kayaker to step into the kayak much as one would into a flat bottom boat before assuming a sitting position. However, a suitable beach is often not available, and when it is, entry/exit from a beach usually entails the kayaker getting their feet wet.

U.S. Pat. Nos. 4,595,373; 4,862,818; and 7,182,032 disclose devices for clamping a paddle to the watercraft purporting to provide stabilization in open water or stabilization and anchoring in shallow water. However, the practicality of such devices for providing stability for entry or exit at a dock or shore is questionable and they do not provide for easy clamping or removal of the paddle.

My US patent application, Publication No. 20110297067 discloses a device that is attached to a dock for supporting and stabilizing a watercraft for entry and exit. However, this device is not readily portable and the user may wish to dock at locations where a device such as the above is not available, so that other means for stabilizing the watercraft at such other locations is desirable.

In view of the above, it would be desirable to provide watercraft users with a simple and inexpensive device that facilitates entry or exit at various locations.

SUMMARY OF THE INVENTION

An object of the present invention is to provide a simple device that facilitates boarding and exit from a small water craft such as a kayak or canoe.

A specific object of the invention is to provide an apparatus adapted for releasably attaching a paddle to a watercraft facilitating its use for stabilizing the watercraft while boarding or exiting.

It has been found that a small watercraft such as a kayak or canoe can be stabilized for boarding/exiting with the use of a quick-release clamping device attached to the watercraft that releasably holds a paddle in a near horizontal position for engaging with an object such as a dock or shore. Utilizing the existing paddle for this additional function of stabilizing reduces the amount of structural components required for the stabilizing function. The selected arrangement and orientation of components minimizes stresses on clamping components while allowing for easy insertion and removal of the paddle.

The present invention provides an apparatus for stabilizing a watercraft for boarding or exiting utilizing a paddle, comprising a quick insert/release paddle clamping device having attachment means for mounting on a watercraft; said clamping device having laterally elongated upper and lower curved opposing jaws forming a generally C-shaped channel with a longitudinal slot for receiving a paddle shaft; said elongated jaws defining laterally spaced paddle shaft gripping regions, spaced laterally along a longitudinal axis of said channel; said jaws having a deflectable lip portion configured to allow insertion and releasably retain the paddle shaft within said channel; said clamping device being disposed, when mounted on a watercraft, with said channel oriented along a substantially horizontal axis transverse to the fore-and-aft axis of the watercraft, and having said slot disposed along a longitudinal side of the channel to allow insertion and removal of the paddle shaft from the channel by fore-and-aft motion thereof, and having gripping regions disposed on upper and lower surfaces of the jaws for opposing vertical forces generated by the paddle shaft, whereby said lateral spacing of the gripping regions provides leverage for minimizing twisting forces imposed on the clamping device from the vertical forces generated by the paddle shaft when the outer end thereof engages an object to limit roll of the watercraft.

BRIEF DESCRIPTION OF THE DRAWINGS

FIG. 1 is a perspective view illustrating one embodiment of the apparatus showing a clamping device according to the present invention, attached to a kayak, and holding a paddle that is contacting the surface of a dock for stability of the kayak.

FIG. 2 is a partly cross-sectional view showing details of an embodiment of the clamping device.

FIG. 3 is a schematic view showing the clamping means in the form of a pair mounted on the gunwales of a watercraft.

DESCRIPTION OF THE PREFERRED EMBODIMENTS

With reference to the embodiment of FIG. 1, the present invention comprises a paddle clamping device 2 having suitable attachment means 7 for mounting on a watercraft 1. In FIG. 1 the clamping device 2 is shown mounted on the deck 11 of a kayak 1. The clamping device includes laterally elongated upper and lower opposing curved jaws 3 and 4. The upper jaw 3 is shown having deflectable lip portions 5 and 6 for removably retaining the shaft of a paddle 10. In FIG. 1, the attachment means includes a base portion 7 which can be bolted or otherwise attached to the watercraft.

The jaws 3 and 4 form a generally C-shaped channel 8, with a paddle shaft receiving slot, dimensioned to partially surround and confine the shaft of a paddle 10. The deflectable lip portions 5 and 6 are configured to allow insertion and removal of the shaft of a paddle 10. The slot is disposed along a longitudinal side of the channel to allow insertion and removal the paddle shaft by fore-and-aft motion.

As shown in FIG. 1, the clamping device, when mounted on a watercraft, retains the paddle shaft in the channel oriented along a substantially horizontal axis transverse or perpendicular to the fore-an-aft axis of the watercraft to which it is mounted.

The jaws 3 and 4 include laterally spaced paddle shaft gripping regions within the channel 8. Gripping regions disposed on upper and lower surfaces of the jaws oppose vertical forces generated by the paddle shaft. Preferably, these gripping regions, are spaced laterally to extend to the outer ends of the channel, such as to the opposite outer ends of lip portions 5 and 6. The lateral spacing along the horizontal axis of said channel provides leverage for reducing twisting forces imposed on the clamping device from the vertical forces generated by the paddle shaft when the outer end, due to roll, engages a dock, or other structure or object, which is shown in FIG. 1 as dock 12. The gripping regions may be contiguous, extending throughout the entire width of the channel, or be separated as shown in the embodiment of FIG. 3, and described below.

FIG. 2 shows a cross-sectional view of a portion of a clamping device 22 supporting a paddle shaft 21 within the C-shaped channel 28. The clamp 22 includes a deflectable lip portion 25 that allows insertion and removal of the paddle shaft 21, via slot 29, and confining the shaft when entering or exiting the watercraft.

The mounting structure shown in FIG. 2 includes pivot means 24 facilitating adjusting the angle of a clamp relative to the base 27, such as for attaching to a curved deck surface. The use of a pivot can also be employed, if desired, for adjusting the angle of a clamping device so that paddle angle deviates somewhat from horizontal, in the case where the surface, or object, the paddle is to make contact with is above or below the level of the clamp. However, in most cases the user will find it acceptable to have the watercraft list or roll as needed to adjust for the difference in level.

The clamping device is designed to resist twisting forces imposed by the paddle shaft, utilizing the leverage of spaced apart paddle shaft gripping regions, while allowing for quick insertion or release of the paddle by horizontal fore-and-aft motion. The clamp may be designed to allow rotation of the paddle shaft within channel 28 when inserted so that the flat end of the paddle can be rotated to match the surface of the dock or chosen contacting surface.

By having the clamp oriented, as described, the arrangement takes advantage of the minimal force needed to snap in or snap out while retaining the clamp's maximum capacity for twisting forces about the roll axis generated by the kayak shaft during kayak entry/exit. Thus, the invention provides a robust yet easy quick engage/release clamp that can withstand relatively large vertical or twisting forces.

The dimensions and configuration of the clamping device will be determined by the diameter of the paddle shaft to be used. Most paddle shaft diameters are in the range of 1.2 to 1.4 inches. The ease of inserting and removing the paddle shaft will be determined by the size of the channel relative to shaft diameter and the flexibility of the deflecting portion of the jaws. It should be noted that both the upper and lower jaws may have deflecting portions. The width of the contact regions should be sufficient to avoid damaging the paddle shaft. The width of the clamps required for resisting the forces by the paddle shaft will be determined by the strength characteristics of the clamp material. It will be apparent that the stresses generated in the clamp and the paddle shaft will be less for a wider clamp, or for a pair of widely spaced clamps. Clamp configurations that provided spacing of the gripping regions about 12 inches or more apart was found to provide adequate resistance to the forces imposed by the paddle.

The embodiment of FIG. 3 shows two separate clamping units 32 and 33 mounted on the gunwales 34 of a watercraft, shown as a canoe 31, providing a relatively large lateral spacing of paddle shaft 30 gripping regions which more readily resists the stresses imposed by the paddle during user entry and exit.

Various materials can be used for the clamping device, selected to provide the desired deflectability of the jaws for facilitating insertion, retention and removal of the paddle shaft. For example, the clamping portion can be constructed of polymer based materials such as polyethylene, polypropylene, or nylon by injection molding. Glass fibers (10 to 35%) may be added to these materials to provide the desired amount of stiffness. Carbon black may be added for UV resistance.

The attachment means for mounting the clamping portion on the watercraft can be integrally constructed with the clamping device, or can include a separate component that interconnects the clamping device to the watercraft.

The clamping device can take various forms, in order to adapt it for various or specific watercraft. Some elements of the clamp or support structure can be integrated into the structure of deck of the watercraft. For example, the watercraft deck can be provided with a recess or flange for housing or supporting the clamping device. The attachment means can take various forms, for example, it may include a base portion that is pivotally connected with the jaws, as shown in FIG. 2, or integrally combined with the jaws as a unitary member, or it may be incorporated integrally with the watercraft structure.

It will also be appreciated that the present invention may be used in a variety of locations, such as at a dock, a shore, or any structure which a paddle can engage.

The procedure for using the present invention is somewhat similar to that when using the known "paddle-bridge" method, but made much easier and safer since the paddle is fixed, freeing up both hands enabling the user to be more effective in controlling and manoeuvring their body into or out of the watercraft. Specifically, with the watercraft adjacent a dock or shore, the user inserts the paddle into the clamping device as shown in FIG. 1, with the watercraft being positioned such that paddle projects laterally outward from the watercraft toward and above the adjacent shore or dock surface. By slight shifting of weight to the shore or dock side of the watercraft, the watercraft can be made to list or roll as required for positioning the paddle to contact the available surface. The paddle may be rotated within the channel so that the blade of the paddle matches that surface. With the paddle contacting a surface, the watercraft is stabilized allowing easy exit with limited rolling motion.

For entry, after inserting the paddle into the clamping device as shown in FIG. 1, the procedure is essentially the reverse of the exit, whereby the user steps into the watercraft slightly off-center to shift weight to the shore or dock side of the watercraft such that the paddle remains in contact with an available surface or object to restrict rolling motion until the user is properly seated in the watercraft.

Although the more common usage of the present device will be near a shore or dock, it can also be used for deep water re-entry, should a kayaker fall out of the kayak. For this, a paddle float is attached to the blade of the paddle, and a distal portion of the paddle shaft inserted into the clamping device as described herein. The paddle float provides an out-rigger like arrangement providing stabilization for re-entry. The clamping device thus simplifies a known technique which involves strapping the paddle shaft to the kayak deck.

The present invention provides a simple device that facilitates boarding and exit from a small water craft such as a kayak or canoe. The configuration provides quick attach/release capabilities for the paddle. Utilizing the existing paddle for the additional function of providing stabilizing reduces the amount of structural components required for providing the stabilizing function, avoiding additional hardware which would need to be stowed.

The invention is especially advantageous for kayakers with reduced upper body strength and flexibility and for novice kayakers who are unable to use, or have difficulty in using, the conventional "paddle-bridge" approach.

What is claimed is:

1. An apparatus for stabilizing a watercraft, for boarding or exiting, utilizing a paddle, comprising:

a paddle clamping device for mounting on a watercraft;

said paddle clamping device having upper and lower opposing jaws, said opposing jaws being laterally elongated and curved forming a generally C-shaped channel with a longitudinal slot for receiving a paddle shaft;

said opposing jaws having gripping regions for the paddle shaft, spaced laterally along a longitudinal axis of said C-shaped channel;

said opposing jaws having a deflectable lip portion configured to allow insertion and releasably retain the paddle shaft within said C-shaped channel;

said paddle clamping device being disposed, when mounted on a watercraft, with said C-shaped channel oriented along a substantially horizontal axis transverse to a fore-and-aft axis of the watercraft, and having said longitudinal slot disposed along a longitudinal side of the C-shaped channel to allow insertion and removal of the paddle shaft from the C-shaped channel by fore-and-aft motion thereof, and whereby the gripping regions of the opposing jaws oppose vertical forces generated by the paddle shaft, and whereby lateral spacing of the gripping regions provides leverage for minimizing twisting forces imposed on the clamping device from vertical forces generated by the paddle shaft when an outer end thereof engages an object to limit roll of the watercraft.

2. The clamping device of claim 1 wherein the deflectable lip portion is resilient to allow deflection when inserting and removing the paddle shaft.

3. The apparatus of claim 1 wherein the paddle clamping device comprises a pair of laterally spaced clamping units for mounting on the watercraft, thereby providing laterally spaced gripping regions for a paddle shaft.

4. The apparatus of claim 1 wherein the paddle clamping device includes a base portion for mounting on a watercraft.

5. The apparatus of claim 4 wherein the opposing jaws of the clamping device are connected pivotally to the base portion.

* * * * *